US009970181B2

(12) United States Patent
Kunz

(10) Patent No.: US 9,970,181 B2
(45) Date of Patent: May 15, 2018

(54) LIP FOR MACHINE BUCKET

(71) Applicant: Caterpillar Inc., Peoria, IL (US)

(72) Inventor: Phillip John Kunz, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 15/076,939

(22) Filed: Mar. 22, 2016

(65) Prior Publication Data

US 2016/0305098 A1 Oct. 20, 2016

Related U.S. Application Data

(60) Provisional application No. 62/148,992, filed on Apr. 17, 2015.

(51) Int. Cl.
*E02F 9/28* (2006.01)
*E02F 3/60* (2006.01)

(52) U.S. Cl.
CPC ..... *E02F 9/2883* (2013.01); *E02F 3/60* (2013.01); *E02F 9/2833* (2013.01)

(58) Field of Classification Search
CPC ..... E02F 9/28–9/2825; E02F 9/2858; E02F 9/2883
USPC ..... 37/444, 446, 450, 451, 460
See application file for complete search history.

(56) References Cited

U.S. PATENT DOCUMENTS 3,388,488 A 6/1968 Duplessis
D246,176 S * 10/1977 Dahlberg ..... D15/32
4,180,926 A 1/1980 Klett et al.
4,317,300 A 3/1982 Emrich et al.
5,452,529 A 9/1995 Neuenfeldt et al.
6,240,663 B1 * 6/2001 Robinson ..... E02F 9/2825 37/455
6,457,269 B1 * 10/2002 Esterhuyse ..... E02F 9/285 172/713
6,848,203 B2 2/2005 Hohmann et al.
(Continued)

FOREIGN PATENT DOCUMENTS

GB 1355071 6/1974
GB 2095643 10/1982
(Continued)

OTHER PUBLICATIONS

U.S. Patent Application of Phillip John Kunz, titled "Tool Retention System," filed Mar. 22, 2016.
(Continued)

*Primary Examiner* — Matthew D. Troutman
(74) *Attorney, Agent, or Firm* — Finnegan, Henderson, Farabow, Garrett & Dunner, LLP

(57) ABSTRACT

A lip for a machine bucket includes a plate portion. The plate portion includes a first surface, a second surface opposite the first surface, and an aperture extending between the first surface and the second surface. The aperture is configured to receive a retention mechanism for attaching a shroud to the plate portion. The lip also includes a deflector projecting from the first surface of the plate portion. The deflector includes a rear portion located between the aperture and a rear edge of the lip. The rear portion forms an inclined surface that is generally flat and that has a height that tapers toward the rear edge of the lip. The inclined surface of the rear portion connects a raised surface of the deflector to the first surface of the plate portion.

15 Claims, 8 Drawing Sheets

(56) References Cited

U.S. PATENT DOCUMENTS

| | | | | |
|---|---|---|---|---|
| 6,928,759 | B2 * | 8/2005 | Kasim | E02F 9/2883 37/452 |
| 6,990,760 | B1 | 1/2006 | Zaayman et al. | |
| 7,832,129 | B2 | 11/2010 | Briscoe | |
| D678,361 | S * | 3/2013 | Attwood | D15/32 |
| 8,434,248 | B2 | 5/2013 | Woerman et al. | |
| 8,720,088 | B2 | 5/2014 | Knight | |
| 8,844,175 | B2 | 9/2014 | Snyder | |
| 8,950,091 | B2 | 2/2015 | Cover | |
| D769,946 | S * | 10/2016 | Kunz | D15/29 |
| 2004/0216335 | A1 | 11/2004 | Jones | |
| 2007/0245601 | A1 | 10/2007 | Bearden et al. | |
| 2009/0217556 | A1 * | 9/2009 | McClanahan | E02F 9/2833 37/451 |
| 2013/0008062 | A1 | 1/2013 | Guimaraes et al. | |
| 2013/0097894 | A1 * | 4/2013 | Pippins | E02F 9/2825 37/455 |
| 2013/0247429 | A1 | 9/2013 | Campomanes | |
| 2013/0318840 | A1 | 12/2013 | Ollinger, IV et al. | |
| 2014/0196324 | A1 | 7/2014 | Carpenter et al. | |
| 2014/0202050 | A1 | 7/2014 | Briscoe et al. | |
| 2014/0230293 | A1 * | 8/2014 | Lunn | E02F 3/40 37/444 |
| 2014/0259809 | A1 | 9/2014 | Campomanes et al. | |
| 2014/0366408 | A1 | 12/2014 | Campomanes | |
| 2014/0366409 | A1 * | 12/2014 | Simpson | E02F 9/2825 37/456 |
| 2015/0007464 | A1 * | 1/2015 | Simpson | E02F 9/2825 37/456 |
| 2015/0013197 | A1 | 1/2015 | Campomanes | |
| 2015/0211215 | A1 * | 7/2015 | Dallard | E02F 3/40 37/448 |
| 2016/0362874 | A1 * | 12/2016 | Hooijmans | E02F 3/60 |
| 2016/0369481 | A1 * | 12/2016 | Hooijmans | E02F 3/60 |

FOREIGN PATENT DOCUMENTS

| | | |
|---|---|---|
| WO | 2009082317 | 7/2009 |
| WO | WO 2011/069183 A1 | 6/2011 |
| WO | WO 2013/037011 A1 | 3/2013 |

OTHER PUBLICATIONS

U.S. Patent Application of Phillip John Kunz et al., titled "Tool Retention System," filed Mar. 22, 2016.

* cited by examiner

LIP FOR MACHINE BUCKET

RELATED APPLICATION

This application is based on and claims benefit of priority of U.S. Provisional Patent Application No. 62/148,992, filed Apr. 17, 2015, which is incorporated herein by reference.

TECHNICAL FIELD

The present disclosure relates generally to a machine bucket, and more particularly, to a lip for a machine bucket.

BACKGROUND

Earth-working machines, such as, for example, draglines, may be used for digging or ripping into the earth or rock and/or moving loosened material from one place to another. These machines may include a bucket for excavating or moving the material. The bucket can be subjected to extreme wear from abrasion and impacts experienced during the earth-working applications.

The bucket may include a lip including a plurality of noses projecting from a front edge of the lip. The lip may also include wing plates located at opposite sides of the lip. Various wear components may be coupled to the lip. For example, teeth may be mountable to the noses, lip shrouds may be mountable between the noses, and wing shrouds may be mountable to the wing plates. The lip and wing shrouds may protect the front edge of the lip. The wear components may be releasably secured to the lip by retention systems, such as retaining members or locking pin systems.

During a dumping operation of the dragline, the material being dumped from the bucket may impact and damage the lip shrouds, the wing shrouds, and the retention systems securing these wear components on the lip, which may shorten their wear life. Also, damaging the retention systems may loosen the retention of the the lip shrouds and the wing shrouds on the lip.

One attempt to protect the retention systems for the wing shrouds is described in U.S. Patent Application Publication No. 2013/0008062 (the '062 publication) to Guimaraes et al. Specifically, the '062 publication discloses that the wing shrouds are releasably retained on the wing plates by retaining members in the form of nut-and-bolt assemblies. The nut-and-bolt assemblies extend substantially perpendicular to the major digging forces and are shielded from material flow by walls of the wing shroud.

While the system of the '062 publication may protect the retaining members for the wing shrouds, it may still be less than optimal. For example, the wing shrouds themselves may not be sufficiently protected from the impact of the material flow. Also, the system of the '062 publication may not sufficiently protect the lip shrouds and the retention members for the lip shrouds.

The disclosed system is directed to overcoming one or more of the problems set forth above.

SUMMARY

In one aspect, the present disclosure is directed to a lip for a machine bucket. The lip includes a plate portion including a first surface, a second surface opposite the first surface, and an aperture extending between the first surface and the second surface. The aperture is configured to receive a retention mechanism for attaching a shroud to the plate portion. The lip also includes a deflector projecting from the first surface of the plate portion. The deflector includes a rear portion located between the aperture and a rear edge of the lip. The rear portion forms an inclined surface that is generally flat and that has a height that tapers toward the rear edge of the lip. The inclined surface of the rear portion connects a raised surface of the deflector to the first surface of the plate portion.

In another aspect, the present disclosure is directed to a lip for a machine bucket. The lip includes a plate portion including a first surface, a second surface opposite the first surface, and an aperture extending between the first surface and the second surface. The aperture is configured to receive a retention mechanism for attaching a shroud to the plate portion. The lip also includes a deflector projecting from the first surface of the plate portion. The deflector includes a rear portion located between the aperture and a rear edge of the lip. The deflector also includes two side portions located between the aperture and respective opposite sides of the plate portion. The deflector forms a recess in which the aperture is located, and the recess is formed between the rear portion and the side portions.

In another aspect, the present disclosure is directed to a lip for a machine bucket. The lip includes a central plate portion, a first wing plate portion, and a second wing plate portion connected to opposite sides of the central plate portion. The lip also includes a deflector projecting from the first wing plate portion. The first wing plate portion includes a first surface facing the second wing plate portion, a second surface opposite the first surface, and an aperture extending between the first surface and the second surface. The aperture is configured to receive a first retention mechanism for attaching a first wing shroud to the first wing plate portion. The deflector is located between the aperture in the first wing plate portion and a rear edge of the first wing plate portion. The deflector forms an inclined surface that is generally flat and that has a height that tapers toward the rear edge of the first wing plate portion. The inclined surface connects a raised surface of the deflector to the first surface of the first wing plate portion.

DETAILED DESCRIPTION

Reference will now be made in detail to exemplary embodiments, which are illustrated in the accompanying drawings. Wherever possible, the same reference numbers will be used throughout the drawings to refer to the same or like parts.

Figure 1:
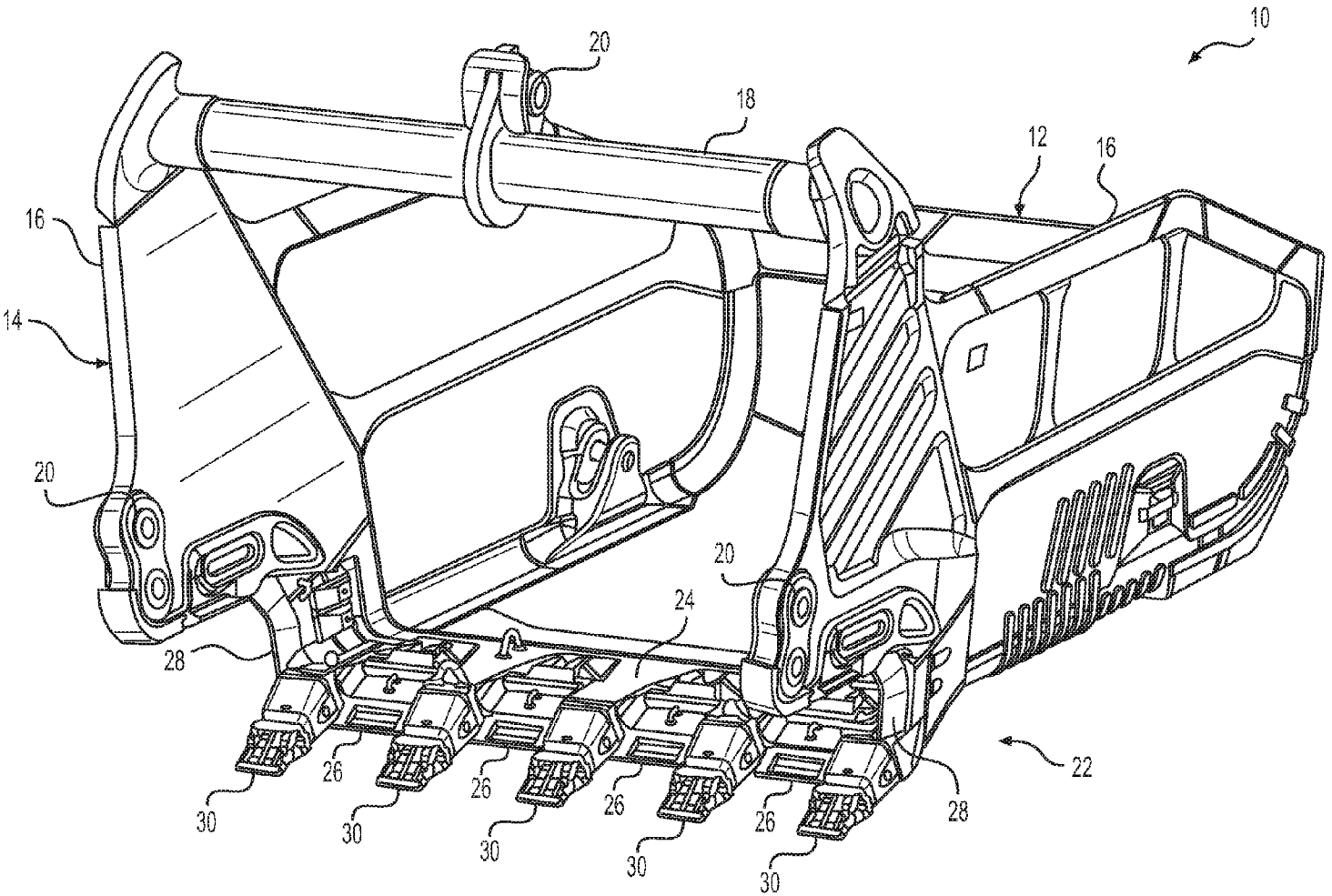
FIG. 1 is a perspective view of a bucket including a lip, lip shrouds, wing shrouds, and retention systems, according to an exemplary embodiment.

An exemplary embodiment of a machine bucket 10 is illustrated in FIG. 1. In the exemplary embodiment, the bucket 10 may be attached to a dragline that is configured to remove material, such as earthen material, with the bucket 10. The dragline may manipulate the bucket 10 by utilizing a hoist mechanism (not shown) and a drag mechanism (not shown) that are controlled by an operator in a machine cabin (not shown) of the dragline. Alternatively, the bucket 10 may be attached to other types of machines known in the art, such as excavators or other earth-working machines.

The bucket 10 may include a main body 12, which may be a box-like structure with an open top, and an open front end 14 through which the material may pass to enter the main body 12. The main body 12 may include side walls 16 that are connected by a cross beam 18. The bucket 10 may include one or more connecting mechanisms 20, e.g., one or more brackets, for connecting to chains or cables used for manipulating the bucket 10. For example, the cross beam 18 may include one or more of the connecting mechanisms 20 for connecting to one or more chains associated with the hoist mechanism, and the side walls 16 may include one or more of the connecting mechanisms 20 for connecting to one or more chains for the drag mechanism.

The bucket 10 may include a wear assembly 22 attached to the main body 12 of the bucket 10, e.g., by welding, and may be replaceable. The wear assembly 22 may include a lip 24 and one or more ground engaging tools (GET) attached to the lip 24, such as one or more lip shrouds 26, one or more wing shrouds 28, and/or a plurality of teeth 30.

Figure 2:
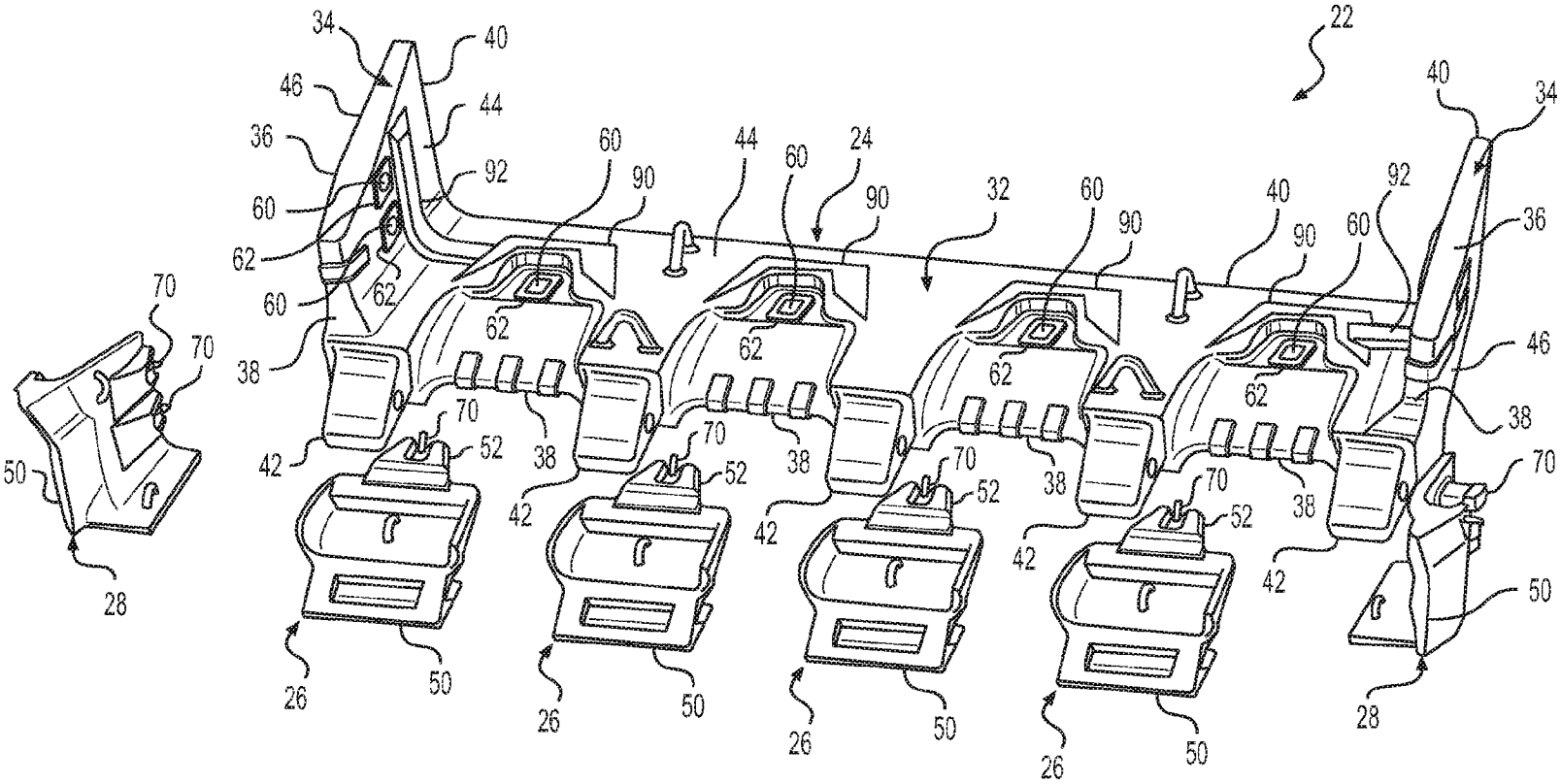
FIG. 2 is an exploded perspective view of the lip, lip shrouds, wing shrouds, and retention systems of FIG. 1.

FIG. 2 is an exploded view of the wear assembly 22, excluding the teeth 30, according to an exemplary embodiment. As shown in FIG. 2, the lip 24 may include a central plate portion 32 and two wing plate portions 34 connected to opposite sides of the central plate portion 32. The wing plate portions 34 may extend upward relative to the central plate portion 32 (e.g., vertically or at an angle that is generally upward). Each wing plate portion 34 may intersect the central plate portion 32 to form a corner and may include a free end forming a side edge 36.

The lip 24 may include a front edge 38 and a rear edge 40 that both extend along the central plate portion 32 and the wing plate portions 34. The central plate portion 32 may include one or more noses 42 that project forwardly from the front edge 38 of the central plate portion 32. The teeth 30 may attach directly or indirectly (e.g., via adapters or couplers) to the noses 42. In an embodiment, the teeth 30 may be two-piece components including a tip that may be connected to an adapter, e.g., by welding, a coupler, or other retaining system. The adapters may be removably connected to the respective noses 42 via a locking pin or other retaining system. Alternatively, the GET (e.g., the lip shrouds 26, the wing shrouds 28, and/or the teeth 30) may take any form known in the art, such as, for example, a single-piece component or multi-piece component that is removably connected to the noses 42, such as a fork or other multi-point configuration, a chisel or blade configuration, a blunt-end configuration, or other single-point configuration.

The terms "front" and "rear" are used herein to refer to the relative positions of the components of the exemplary wear assembly 22. When used herein, "front" refers to one side of the wear assembly 22, e.g., closer to the tips of the noses 42 of the lip 24 and/or the teeth 30 attached to the noses 42. In contrast, "rear" refers to the side of the wear assembly 22 that is opposite the front side. The rear side of the wear assembly 22 may be the side that is connected to the main body 12 of the bucket 10 when the wear assembly 22 is attached to the main body 12.

The lip 24 may include a first surface 44 and a second surface 46 opposite the first surface 44. The first surface 44 may form an upper surface of the central plate portion 32 and inwardly-facing surfaces of the wing plate portions 34 (the surfaces of the wing plate portions 34 that face each other). The second surface 46 may form a lower surface of the central plate portion 32 and outwardly-facing surfaces of the wing plate portions 34.

The lip shrouds 26 and the wing shrouds 28 may protect the front edge 38 of the lip 24. The lip shrouds 26 may be mountable on the central plate portion 32 between the noses 42, and the wing shrouds 28 may be mountable on the wing plate portions 34. As shown in FIGS. 1 and 2, the wear assembly 22 may include five teeth 30 that are spaced apart along the length of the lip 24, four lip shrouds 26 that are located between adjacent teeth 30, and two wing shrouds 28. Each of the teeth 30, the lip shrouds 26, and the wing shrouds 28 may be replaceable and designed to protect a different portion of the lip 24 from abrasive wear. Alternatively, other numbers of the teeth 30, the lip shrouds 26, and the wing shrouds 28 may be provided, depending on the application.

Figure 3:
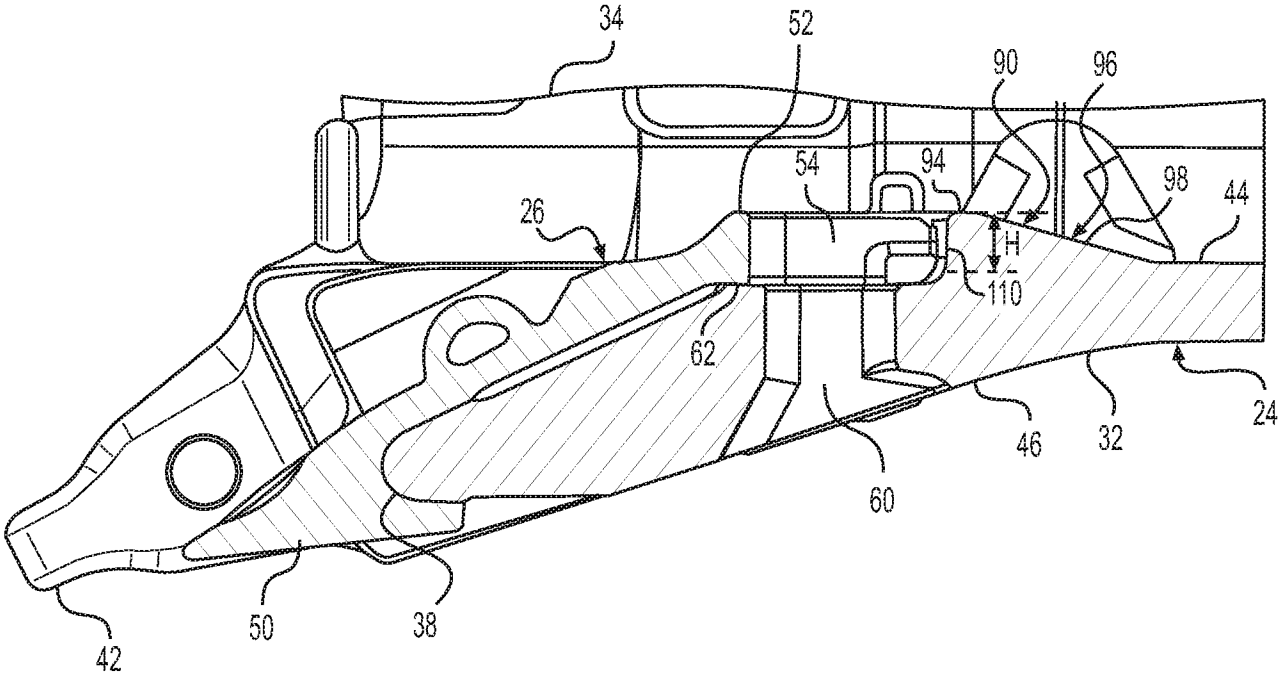
FIG. 3 is a cross-sectional view of one of the lip shrouds positioned on the lip of FIG. 1.
Figure 4:
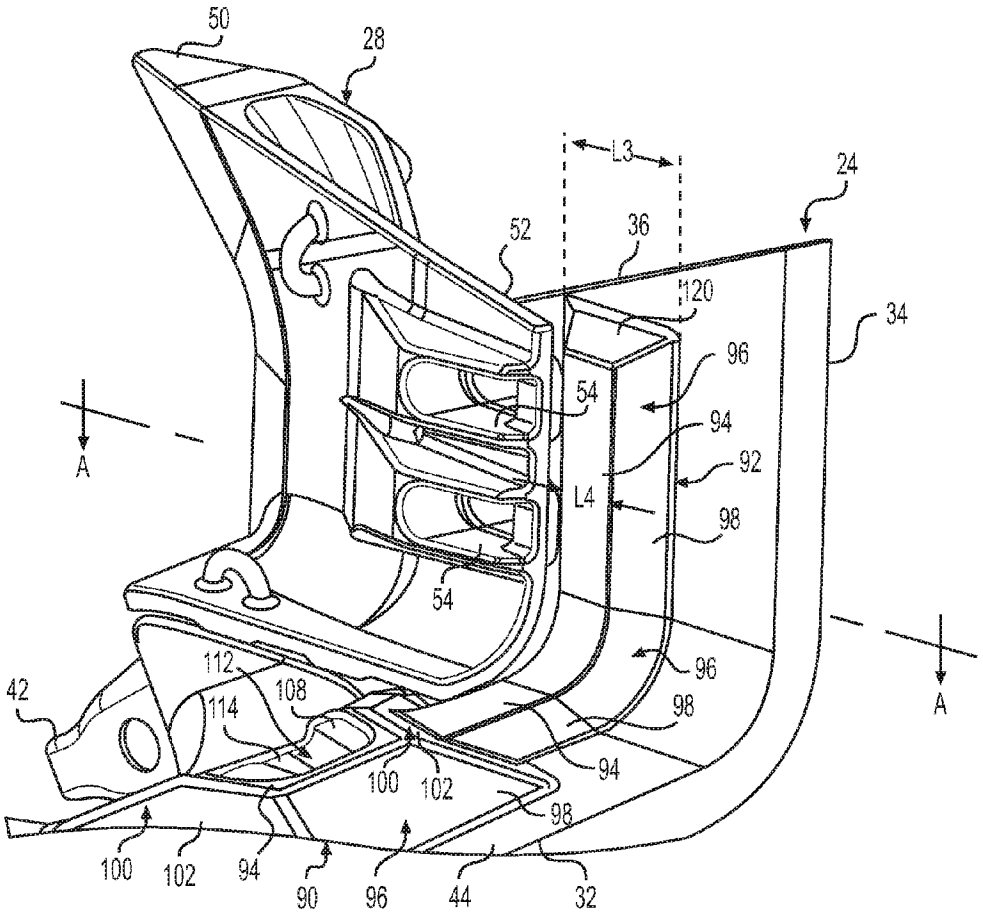
FIG. 4 is a perspective view of one of the wing shrouds positioned on the lip of FIG. 1.
Figure 5:
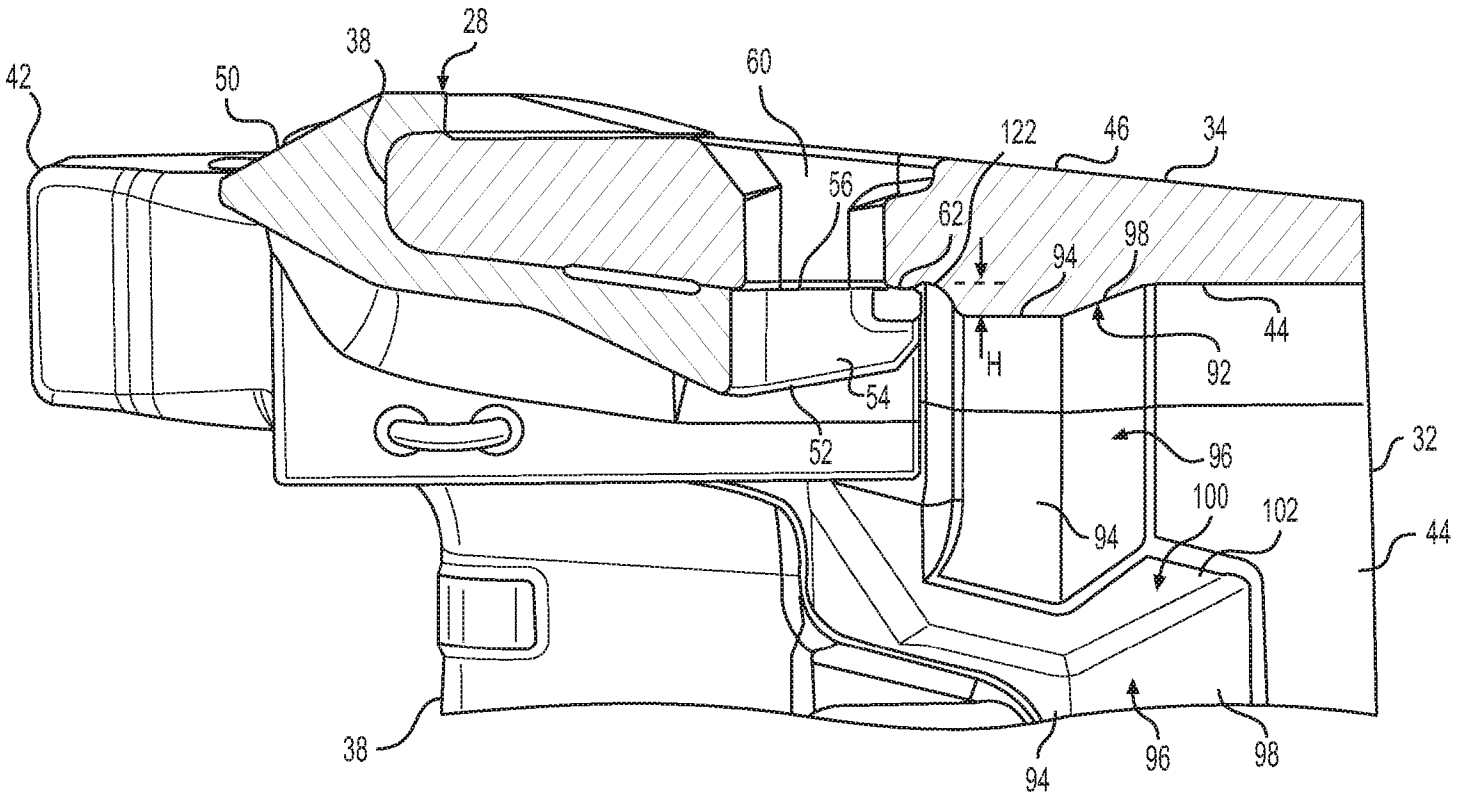
FIG. 5 is a cross-sectional view of one of the wing shrouds positioned on the lip taken along the line A-A of FIG. 4.

FIG. 3 shows one of the lip shrouds 26 positioned on the lip 24, and FIGS. 4 and 5 shows one of the wing shrouds 28 positioned on the lip 24, according to an exemplary embodiment. Each of the lip shrouds 26 and the wing shrouds 28 may include a front edge portion 50 that hooks over the front edge 38 of the lip 24 (e.g., the front edge of the central plate portion 32 or the wing plate portion 34). Each of the lip shrouds 26 and the wing shrouds 28 may also include a rear mounting portion 52 including an aperture 54. The rear mounting portion 52 may have a bottom surface 56 that may be generally flat.

The lip 24 (e.g., the central plate portion 32 and/or the wing plate portion 34) may include apertures 60 that extend between the first surface 44 and the second surface 46. The apertures 60 may align with the apertures 54 in the lip shrouds 26 and the wing shrouds 28 positioned on the lip 24. The lip 24 may also include generally flat mounting surfaces 62 that at least partially surround the apertures 60. When the lip shrouds 26 and the wing shrouds 28 are positioned on the lip 24, the generally flat bottom surfaces 56 of the rear mounting portions 52 of the lip shrouds 26 and the wing shrouds 28 may be supported by the generally flat mounting surfaces 62 of the lip 24.

The apertures 54 and 60 may be configured to align when the lip shrouds 26 and the wing shrouds 28 are positioned on the lip 24, and may be configured to receive respective retention systems 70. The retention systems 70 may be configured to clamp or attach the lip shrouds 26 and the wing shrouds 28 in a removable manner to the lip 24. As shown in FIG. 2, the central plate portion 32 may include four of the apertures 60 configured to receive four retention systems 70 for attaching four lip shrouds 26 to the central plate portion 32, and the wing plate portions 34 may each include a pair of the apertures 60 configured to receive a pair of retention systems 70 for attaching one wing shroud 28.

Figure 6:
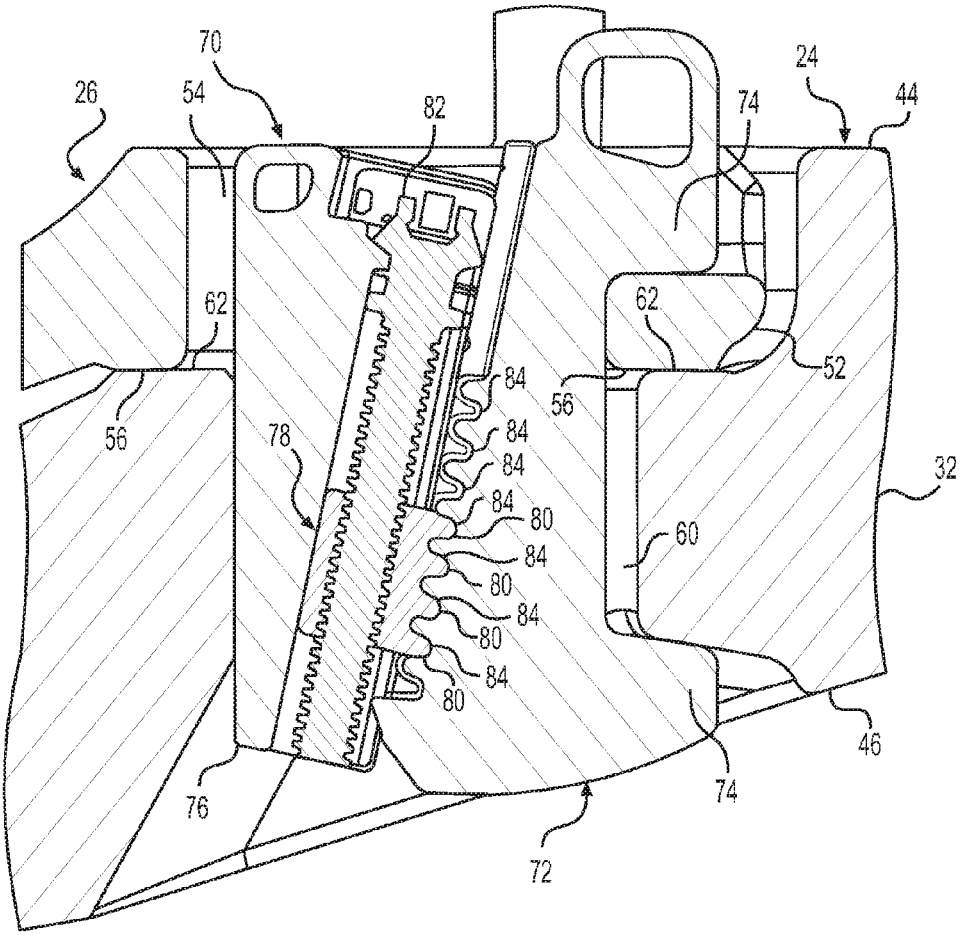
FIG. 6 is a cross-sectional view of one of the retention systems attaching one of the lip shrouds to the lip of FIG. 1.

An exemplary embodiment of the retention system 70 for attaching the lip shroud 26 to the lip 24 is illustrated in FIG. 6. In an embodiment, the retention system 70 may include a generally C-shaped clamp 72 with two clamping arms 74. The retention system 70 may also include a wedge 76, a slider 78 with teeth 80 that engage the clamp 72, and a fastener 82. The clamp 72 may pass through the aperture 54 in the lip shroud 26 and the corresponding aperture 60 in the lip 24. The clamping arms 74 may clamp the rear mounting portion 52 of the lip shroud 26 against the mounting surface 62 on the central plate portion 32 of the lip 24. The wedge 76 may be inserted into the apertures 54 and 60 alongside the clamp 72 and used to hold the clamp 72 in place. The slider 78 may include threads that engage with threads on the fastener 82, and the fastener 82 may be rotatable to move the slider 78 along the fastener 82. The teeth 80 on the slider 78 may engage with grooves 84 on the clamp 72 upon insertion of the wedge 76 into the apertures 54 and 60 such that, as the fastener 82 is rotated and the slider 78 moves along the fastener 82, the wedge 76 is forced into or out of the apertures 54 and 60, depending on the direction of rotation. The movement of the wedge 76 may correspond with the clamping forces generated by the clamp 72 on the lip shroud 26 and the lip 24 such that, as the wedge 76 is forced further into the apertures 54 and 60, the clamp 72 is urged tighter against the lip shroud 26 and the lip 24. Thus, the retention system 70 allows the lip shroud 26 to be removably connected to the lip 24 by rotation of the fastener 82. The retention system 70 for attaching the wing shroud 28 to the lip 24 may be similar or identical to the retention system 70 for attaching the lip shroud 26 to the lip 24.

Figure 8:
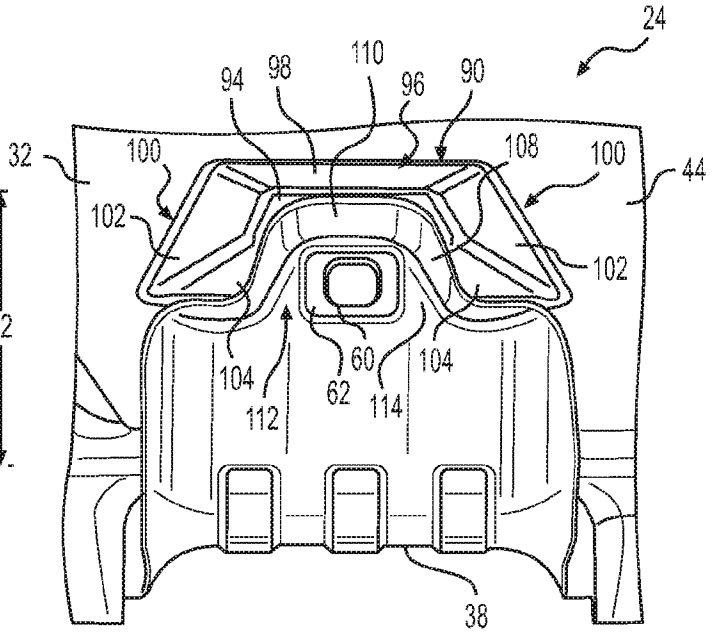
FIG. 8 is a perspective view of another deflector of the lip of FIG. 1.
Figure 7:
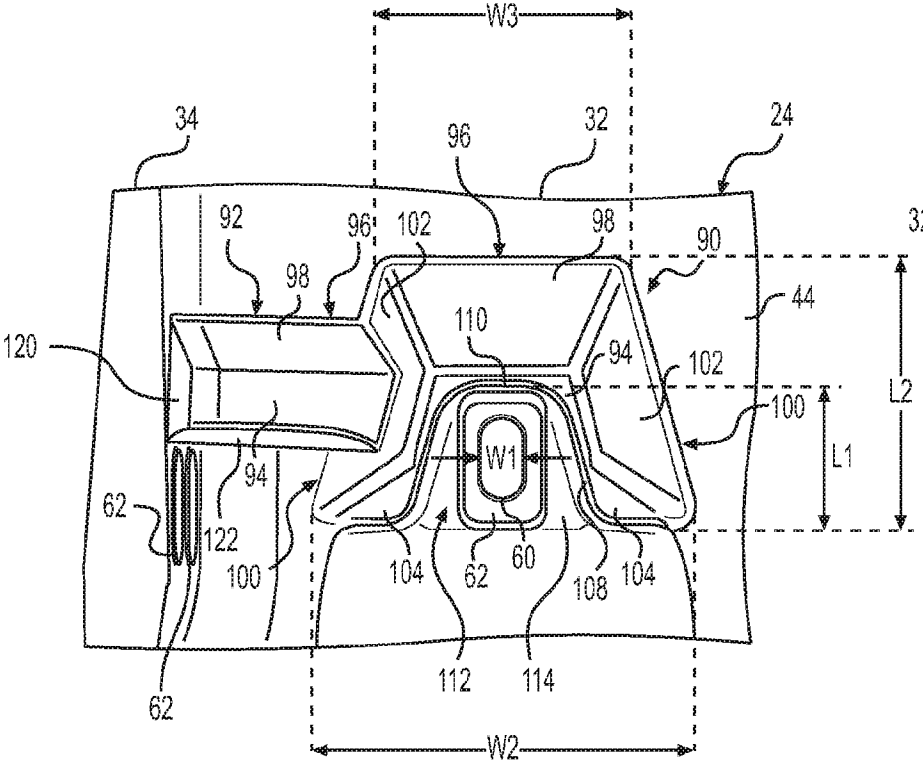
FIG. 7 is a top view of a deflector of the lip of FIG. 1.

The lip 24 may include one or more deflectors configured to deflect material over the retention system 70, the lip shrouds 26, and/or the wing shrouds 28. FIGS. 7 and 8 show two deflectors 90 on the central plate portion 32 of the lip 24, according to an exemplary embodiment. A deflector 92 on one of the wing plate portions 34 of the lip 24 is shown in FIG. 4.

The deflectors 90 shown in FIGS. 7 and 8 may be similar to each other except that the deflector 90 shown in FIG. 7 may be connected directly to the deflector 92 on one of the wing plate portions 34. The deflector 90 shown in FIG. 8 may be located between two other deflectors 90 on the central plate portion 32 and may not connect directly to the deflector 92 on one of the wing plate portions 34. In the embodiment shown in FIGS. 1-9, the lip 24 may include four deflectors 90 on the central plate portion 32 located rearward of four lip shrouds 26, respectively, and two deflectors 92 on the wing plate portions 34 located rearward of two wing shrouds 28, respectively. As shown in FIG. 2, the two deflectors 90 located closest to the respective wing plate portions 34 may connect to the respective deflectors 92 on the wing plate portions 34.

Each of the deflectors 90 on the central plate portion 32 may deflect material over the lip shroud 26 and the retention system 70 located in front of the respective deflector 90. Similarly, each of the deflectors 92 on the wing plate portions 34 may deflect material over the wing shroud 28 and the retention system 70 located in front of the respective deflector 92. Each deflector 90 and 92 may project from the first surface 44 of the corresponding central plate portion 32 or wing plate portion 34, and may form a raised surface 94 that is raised with respect to the first surface 44 of the corresponding central plate portion 32 or wing plate portion 34.

Each deflector 90 and 92 may include a rear portion 96 extending rearward from the raised surface 94 toward the rear edge 40 of the lip 24. The rear portion 96 may be located between the aperture 60 in the lip 24 for receiving the retention system 70 and the rear edge 40 of the lip 24. The rear portion 96 may form a rear inclined surface 98 that may be generally flat and may connect the raised surface 94 to the first surface 44 of the corresponding central plate portion 32 or wing plate portion 34. The height of the rear inclined surface 98 may taper rearward toward the rear edge 40 of the lip 24 so as to be continuous with the first surface 44 of the corresponding central plate portion 32 or wing plate portion 34. The angle of taper may depend on the length of the rear portion 96 and/or the length of the rear inclined surface 98 along the forward-rear direction. In an embodiment, the angle of taper may be about 5 degrees to about 45 degrees, or about 10 degrees to about 20 degrees (e.g., about 15 degrees) with respect to the first surface 44 of the corresponding central plate portion 32 or wing plate portion 34.

Each deflector 90 and 92 may have a width that is greater than a width W1 of the aperture 60 located in front of the respective deflector 90 and 92. Each deflector 90 and 92 may extend behind the entire aperture 60. For example, as shown in FIG. 7, each deflector 90 on the central plate portion 32 may taper rearward from a width W2 at a front end of the deflector 90 to a width W3 at a rear end of the deflector 90. Both widths W2 and W3 may be greater than the width W1 of the aperture 60. In an embodiment, the width W2 may be about 300 millimeters to about 900 millimeters (e.g., about 600 millimeters), the width W3 may be about 200 millimeters to about 600 millimeters (e.g., about 400 millimeters), and the width W1 of the aperture 60 may be about 40 millimeters to about 120 millimeters (e.g., about 80 millimeters).

Figure 9:
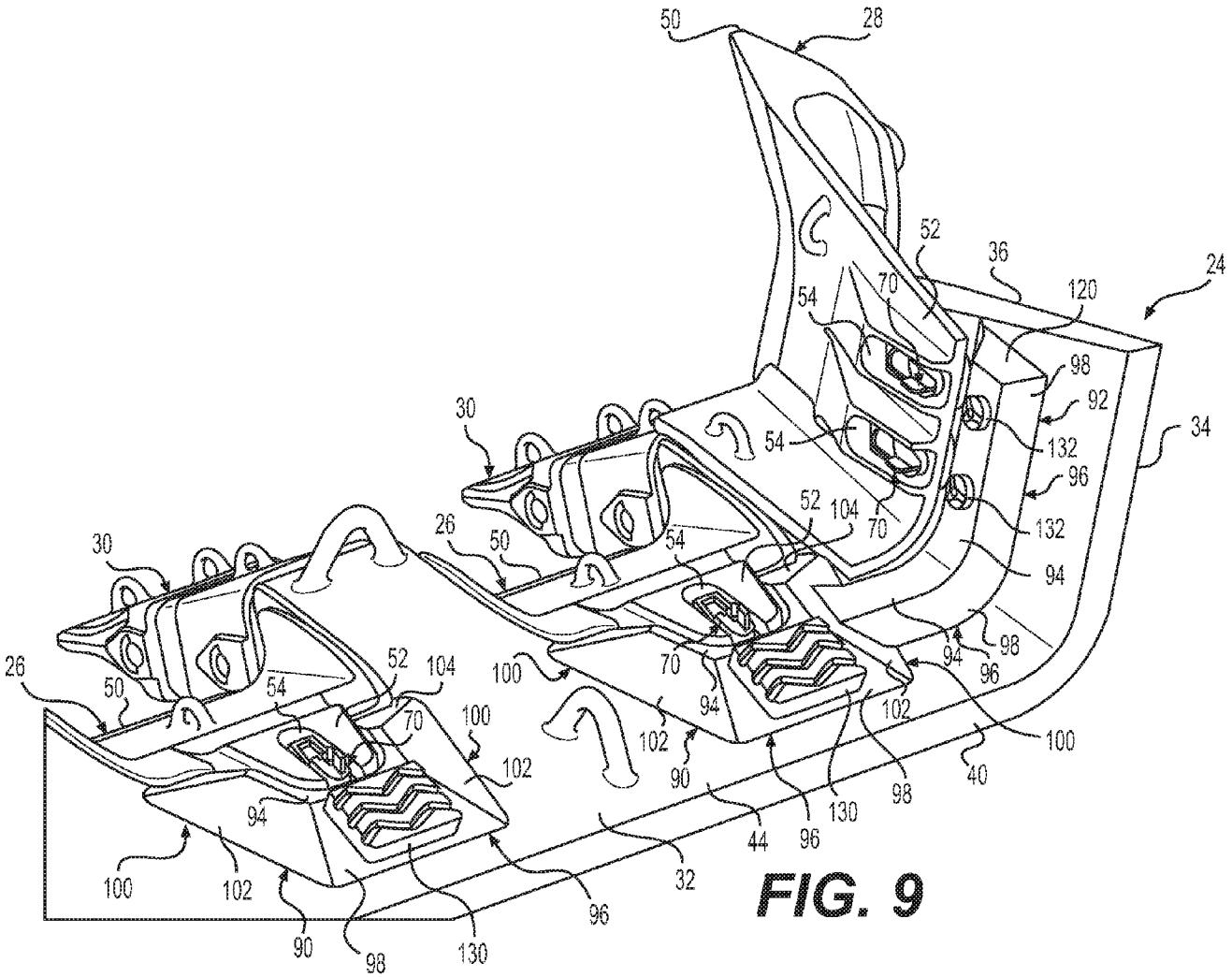
FIG. 9 is a perspective view of wear bars and wear buttons attached to the lip of FIG. 1.

Each deflector 90 on the central plate portion 32 may also include one or more side portions 100 connected to the rear portion 96 and extending sideways from the raised surface 94 toward one or both sides of the central plate portion 32. For example, as shown in FIGS. 7 and 8, the deflector 90 may include two side portions 100 connected to opposite sides of the rear portion 96. Each side portion 100 may be located between the aperture 60 in the lip 24 for receiving the retention system 70 and the respective sides of the central plate portion 32. Each side portion 100 may form a side inclined surface 102 that may be generally flat and may connect the raised surface 94 to the first surface 44 of the central plate portion 32. The height of the side inclined surface 102 may taper toward the respective sides of the central plate portion 32 so as to be continuous with the first surface 44 of the central plate portion 32. Each side portion 100 may also form a front inclined surface 104 that is located at the front end of the side portion 100 and that may be generally flat. The height of the front inclined surface 104 may taper toward a front end of the deflector 90, which may abut or be adjacent to a portion of the lip shroud 26 when the lip shroud 26 is positioned on the lip 24, as shown in FIG. 9.

The rear portion 96 and the side portions 100 of the deflector 90 may generally form a U-shape. Alternatively, the rear portion 96 and the side portions 100 of the deflector 90 may generally form a V-shape or other shape. As shown in FIGS. 7 and 8, the inner surfaces of the rear portion 96 and the side portions 100 may form a generally U-shaped surface 108. As shown in FIG. 3, the rear portion 96 may include a front surface 110 that forms part of the U-shaped surface 108. The U-shaped surface 108 may be formed by surfaces of the rear portion 96 and the side portions 100 facing the aperture 60.

A recess 112 may be formed in each deflector 90 and may be defined by the U-shaped surface 108. The recess 112 may be formed between the rear portion 96 and the side portions 100. The recess 112 may receive the rear mounting portion 52 of the lip shroud 26 when the lip shroud 26 is positioned on the lip 24. The aperture 60 for receiving the retention system 70 may be formed in a bottom surface 114 of the recess 112. The bottom surface 114 of the recess 112 may also include the mounting surface 62 surrounding the aperture 60, and the bottom surface 56 of the rear mounting portion 52 of the lip shroud 26 may rest on the bottom surface 114 of the recess 112.

The U-shaped surface 108 defining the recess 112 may be shaped to correspond to the outer shape of the rear mounting portion 52 of the lip shroud 26. For example, the recess 112 may have a length L1 (FIG. 7) along a forward-rear direction of approximately equal to a length of the rear mounting portion 52 positioned in the recess 112 when the the lip shroud 26 is positioned on the lip 24. In an embodiment, the length L1 may be about 110 millimeters to about 330 millimeters (e.g., about 220 millimeters). In an embodiment, the width of the recess 112 may taper toward a rear end of the recess 112. For example, the width of the recess 112 at the front end of the recess 112 may be about 150 millimeters to about 450 millimeters (e.g., about 300 millimeters).

As described above, each deflector 90 may taper rearward from the front end of the deflector 90 to the rear end of the deflector 90. The angle of the taper may depend on the shape of the U-shaped surface 108. For example, in an embodiment, the top and bottom edges of the side inclined surfaces 102 may be at least partially parallel to the U-shaped surface 108.

The aperture 60 may be entirely surrounded on at least three sides by the U-shaped surface 108. Each deflector 90 may have a length L2 (FIG. 7) that is greater than the length of the aperture 60. In an embodiment, the length L2 may be about 210 millimeters to about 630 millimeters (e.g., about 420 millimeters).

The raised surface 94 of the deflector 90 may have a height H (FIG. 3) with respect to the bottom surface 114 of the recess 112 that may be approximately equal to a height of the rear mounting portion 52 of the lip shroud 26 positioned in front of the deflector 90. In an embodiment, the height may be about 25 millimeters to about 75 millimeters (e.g., about 50 millimeters).

Each deflector 92 on the wing plate portions 34 may have a width that extends along at least a majority of a width of the respective wing plate portion 34. As shown in FIG. 4, the deflector 92 may form a bar that extends along a majority of the width of the wing plate portion 34 between the corner (at the intersection between the wing plate portion 34 and the central plate portion 32) and the side edge 36 of the lip 24. The top surface of the bar may form the raised surface 94, which may include at least a portion that is generally flat. Each wing plate portion 34 may include a plurality of the apertures 60, and the apertures 60 may be located side-by-side along the width of the wing plate portion 34 such that the deflector 92 extends along the width of the wing plate portion 34 behind each of the apertures 60. For example, as shown in FIG. 4, the wing plate portion 34 may include two apertures 60 located side-by-side, and the deflector 92 extends behind both apertures 60 so that both apertures 60 are entirely in front of the deflector 92.

A first end of the bar formed by the deflector 92 may form a side surface 120 located near the free end of the wing plate portion 34. The bar may extend generally parallel to the longitudinal axis of the lip 24. A second end of the bar may be located on the central plate portion 32 so that the deflector 92 may extend at least partially onto the first surface 44 of the central plate portion 32. The deflector 92 may curve around the corner formed by the intersection of the central plate portion 32 and the wing plate portion 34. The raised surface 94 of the deflector 92 may also curve as the deflector 92 curves around the corner. As shown in FIG. 4, the deflector 92 (e.g., the rear portion 96) may connect to the side portion 100 of the deflector 90 that is closest to the deflector 92. Alternatively, the second end of the bar may be located on the wing plate portion 34, and the deflector 92 may not extend along the corner.

As shown in FIG. 5, each deflector 92 may also form a front surface 122 that faces the front edge 38 of the lip 24. The front surface 122 may form a concave surface that curves inward into the deflector 92 from the raised surface 94 toward the mounting surface 62 surrounding the aperture 60. The raised surface 94 of the deflector 92 may have a height H (FIG. 5) with respect to the mounting surface 62 surrounding the aperture 60 that may be approximately equal to a height of the rear mounting portion 52 of the wing shround 28 positioned in front of the deflector 92. In an embodiment, the height may be about 25 millimeters to about 75 millimeters (e.g., about 50 millimeters). Alternatively, the height of the raised surface 94 of the deflector 92 may be different from the height of the raised surface 94 of the deflector 90.

The length of the raised surface 94 and/or the rear portion 96 of the deflectors 90 and 92 along the forward-rear direction may depend on the application. For example, the length of the raised surface 94 of the deflector 92 and/or the rear portion 96 of the deflector 90 may be sufficient to allow the attachment of one or more wear bars 130 and/or one or more wear buttons 132. Also, the raised surface 94 of the deflector 92 and/or the rear inclined surfaces 98 of the deflector 90 may be generally flat to allow the wear bars 130 and/or the wear buttons 132 to be attached. FIG. 9 shows an exemplary embodiment of the lip 24 with wear bars 130 attached to the respective rear inclined surfaces 98 of the deflectors 90 and with two wear buttons 132 attached to the raised surface 94 of the deflector 92, according to an exemplary embodiment. The wear bars 130 and the wear buttons 132 may further deflect material over the lip shrouds 26, the wear shrouds 28, and the retention system 70 located in front of the respective deflectors 90 and 92. The wear bars 130 and the wear buttons 132 may be aligned with to the apertures 60 located in front of the deflectors 90 and 92.

Thus, as shown in FIG. 9, two wear buttons 132 may be provided behind the two apertures 60. The wear bars 130 and the wear buttons 132 may be welded to the deflectors 90 and 92. In an embodiment, the wear bars 130 and the wear buttons 132 may be formed of one or more metals and/or metal alloys. For example, each of the wear bars 130 and the wear buttons 132 may include a bottom portion that is formed of mild steel and a top portion that is formed of a relatively harder material, such as white iron. The bottom portion may be welded to the deflectors 90 and 92. Alternatively, other numbers of the wear bars 130 and the wear buttons 132 may be provided, depending on the application (e.g., depending on the number of apertures 60 in the lip 24).

In an embodiment, the rear portion 96 of the deflectors 90 may have a length of about 100 millimeters to about 300 millimeters (e.g., about 200 millimeters) along the forward-rear direction, and the rear portion 96 of the deflectors 92 may have a length L3 (FIG. 4) of about 90 millimeters to about 270 millimeters (e.g., about 180 millimeters) along the forward-rear direction. The raised surface 94 of the deflectors 92 may have a length L4 (FIG. 4) of about 50 millimeters to about 150 millimeters (e.g., about 100 millimeters) along the forward-rear direction.

INDUSTRIAL APPLICABILITY

The disclosed lip may be applicable to any machine bucket having removable wear components, such as lip and wing shrouds. Several advantages may be associated with the disclosed lip. The lip, the wear components that are attached to the lip, and the retention systems for attaching the wear components to the lip may exhibit improved performance and longer wear life.

The deflectors 90 and 92 may project from the first surface 44 of the corresponding central plate portion 32 or wing plate portion 34, and may form the raised surface 94 that is raised with respect to the first surface 44 of the corresponding central plate portion 32 or wing plate portion 34. The deflectors 90 and 92 may taper from the raised surface 94 toward the edges of the deflectors 90 and 92. As a result, when the material is dumped from the bucket 10, the flow of material may deflect over the lip shrouds 26, the wing shrouds 28, and the retention systems 70. There may be less of an impact on these components from the flow of material, thereby reducing the wear and tear on the components. As a result, the lip shrouds 26, the wing shrouds 28, and the retention systems 70 may have a longer wear life, which may reduce the frequency at which the components are replaced. Also, the dragline operation may be interrupted less frequently to replace the components. In addition, the retention systems 70 may be able to maintain a more secure connection between the lip 24, the lip shrouds 26, and the wing shrouds 28.

The deflectors 90 and 92 may also include generally flat areas on the raised surfaces 94 and/or the rear inclined surfaces 98. As a result, the wear bars 130 and the wear buttons 132 may be securely attached to these generally flat surfaces.

The deflectors 90 on the central plate portion 32 may generally form a U-shape, which may protect the lip shrouds 26, the wing shrouds 28, and the retention systems 70 from the impact of the flow of material from the sides and the rear.

In addition, the lip 24, including the features described above, such as the central plate portion 32, the wing plate portions 34, the noses 42, and the deflectors 90 and 92, may be formed integrally as a single-piece cast metal component. Alternatively, one or more of these features, e.g., the deflectors 90 and 92, may be welded onto the lip 24.

It will be apparent to those skilled in the art that various modifications and variations can be made to the disclosed lip. Other embodiments will be apparent to those skilled in the art from consideration of the specification and practice of the disclosed lip. It is intended that the specification and examples be considered as exemplary only, with a true scope being indicated by the following claims and their equivalents.

What is claimed is:

1. A lip for a machine bucket, the lip comprising:

a plate portion including a central plate portion extending between two wing plate portions, the plate portion including a front edge and a back edge, a first surface and a second surface opposite the first surface, each of the first surface and the second surface extending between the front edge and the back edge, and an aperture extending between the first surface and the second surface, the aperture being configured to receive a retention mechanism for attaching a shroud to the plate portion;

a plurality of shroud mounting portions on the plate portion extending rearward from the front edge and including at least one lip shroud mounting portion positioned on the central plate portion, and at least one wing shroud mounting portion positioned on one of the two wing plate portions;

a plurality of noses projecting forward from the front edge of the central plate portion and each structured for mounting a tooth; and a deflector positioned rearward of one of the plurality of shroud mounting portions, and projecting from the first surface of the plate portion, the deflector including a rear portion located between the aperture and a rear edge of the lip and having a height above the first surface that tapers in a rearward direction such that the deflector slopes rearwardly toward the first surface of the plate portion, wherein the deflector includes a wing section positioned on one of the two wing plate portions, a central section positioned on the central plate portion, and a curved transition section extending between the wing section and the central section.

2. The lip of claim 1, wherein the deflector has a width that is greater than a width of the aperture such that the deflector extends behind the entire aperture.

3. The lip of claim 1, wherein the deflector includes a raised surface and an inclined surface that slopes rearwardly from the raised surface, wherein the inclined surface is inclined at an angle of about 5 degrees to about 45 degrees with respect to the first surface of the plate portion.

4. The lip of claim 1, wherein:

the deflector further includes side portions connected to opposite sides of the rear portion, the side portions being located between the aperture and respective sides of the plate portion; and the deflector forms a U-shaped surface defining a recess in which the aperture is located, the recess being formed between the rear portion and the side portions.

5. The lip of claim 1, wherein each of the two wing plate portions extends upward relative to the central plate portion.

6. The lip of claim 1, wherein the aperture is in the wing plate portion, and the rear portion is a first rear portion located between the aperture and the rear edge of the lip, the deflector is a first deflector, and the lip further includes:

a second deflector including a second rear portion located between a second aperture in the central plate portion and the rear edge of the lip, the second rear portion forming an inclined surface that is generally flat and that has a height that tapers in a rearward direction such that the second deflector slopes rearwardly toward the first surface, inclined surface of the second rear portion connecting a raised surface of the second deflector to the first surface of the central plate portion.

7. The lip of claim 6, wherein the second deflector includes side portions located at opposite sides of the second rear portion, the side portions being located between the aperture and respective sides of the central plate portion, the rear portion of the first deflector connecting to one of the side portions of the second deflector.

8. The lip of claim 1, wherein the deflector includes a raised surface, and wherein at least a portion of the raised surface is generally flat.

9. The lip of claim 1 wherein the deflector is a first deflector, the lip further includes a second deflector, and the second deflector abuts the first deflector.

10. A lip for a machine bucket, the lip comprising:

a plate portion including a front edge, a back edge, a first surface, a second surface opposite the first surface, an aperture extending between the first surface and the second surface, and a shroud mounting portion extending between the front edge and the aperture; and a deflector positioned between the shroud mounting portion and the back edge of the plate portion, the deflector projecting from the first surface of the plate portion, and including:

a rear portion located between the aperture and the back edge of the plate portion, and two side portions located between the aperture and respective opposite sides of the plate portion;

wherein the deflector forms a recess in which the aperture is located, the recess being formed between the rear portion and the side portions; and wherein the deflector has a height above the first surface that tapers in a rearward direction such that the deflector slopes rearwardly towards the first surface, wherein each side portion slopes toward the first surface and forms an inclined surface, each inclined surface being generally flat and having a height that slopes toward the first surface.

11. The lip of claim 10, wherein the rear portion of the deflector slopes rearward toward the back edge of the plate portion, and the rear portion forms an inclined surface that is generally flat and that has a height that slopes toward the first surface.

12. The lip of claim 10, wherein the rear portion and the side portions generally form a U-shape with the recess being defined by a generally U-shaped surface.

13. The lip of claim 10, wherein the recess has a bottom surface that forms a generally flat mounting surface surrounding the aperture for supporting at least a portion of a shroud.

14. A lip for a machine bucket, the lip comprising:

a plate portion including a first wing plate portion, a second wing plate portion, and a central plate portion extending between the first and the second wing plate portions, the first and the second wing plate portions each being generally orthogonal to the central plate portion, and the plate portion further including a front edge and a back edge, a first surface and a second surface opposite the first surface, a shroud mounting portion extending rearward from the front edge, and an aperture extending between the first and the second surface; and a deflector positioned rearward of the shroud mounting portion and projecting from the first wing plate portion, the deflector including a raised surface, and a rear portion rearward of the raised surface, the rear portion including an inclined surface;

wherein the deflector has a height above the first surface that tapers in a rearward direction from the raised surface such that the inclined surface slopes downward toward the first surface, the height being the distance between the first surface and the raised surface; and wherein each of the raised surface and the inclined surface extends in a fore to aft direction between the front edge and the back edge of the plate portion, and in a second direction generally orthogonal to the fore to aft direction, the second direction running generally parallel to the front edge of the first wing plate portion, wherein the deflector includes a wing section positioned on the first wing plate portion, a central section positioned on the central plate portion, and a curved transition section extending between the wing section and the central portion.

15. The lip of claim 14, wherein the first wing plate portion and the central plate portion form a first corner, the first wing plate portion includes a free end forming a first side edge, and the deflector extending along a majority of a width of the first wing plate portion between the first corner and the first side edge.

* * * * *